US007582598B2

(12) United States Patent
Hecht et al.

(10) Patent No.: US 7,582,598 B2
(45) Date of Patent: Sep. 1, 2009

(54) OLIGOMERIC ALKYL GLYCERYL SULFONATE AND/OR SULFATE SURFACTANT MIXTURE AND A DETERGENT COMPOSITION COMPRISING THE SAME

(75) Inventors: Stacie Ellen Hecht, West Chester, OH (US); Jeffrey Charles Cummins, Cincinnati, OH (US); Jeffrey John Scheibel, Loveland, OH (US); Graeme William Biggin, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 405 days.

(21) Appl. No.: 11/243,060

(22) Filed: Oct. 4, 2005

(65) Prior Publication Data

US 2006/0079433 A1 Apr. 13, 2006

Related U.S. Application Data

(60) Provisional application No. 60/617,614, filed on Oct. 8, 2004.

(51) Int. Cl.
*C11D 17/00* (2006.01)
*C11D 17/08* (2006.01)

(52) U.S. Cl. ..... 510/424

(58) Field of Classification Search ..... 510/424
See application file for complete search history.

(56) References Cited

U.S. PATENT DOCUMENTS

| | | | | | |
|---|---|---|---|---|---|
| 2,877,185 | A | * | 3/1959 | Krumrei et al. | 510/401 |
| 2,988,511 | A | * | 6/1961 | Mills et al. | 510/151 |
| 4,024,078 | A | * | 5/1977 | Gilbert et al. | 510/425 |
| 4,217,296 | A | | 8/1980 | Berkowitz | |
| 5,117,032 | A | | 5/1992 | Fabry et al. | |
| 5,712,233 | A | * | 1/1998 | Rasheed | 510/174 |
| 5,783,200 | A | * | 7/1998 | Motley et al. | 424/401 |

* cited by examiner

*Primary Examiner*—Mark Eashoo
*Assistant Examiner*—Thuy-Ai N Nguyen
(74) *Attorney, Agent, or Firm*—Laura R Grunzinger; Idris N. McKelvey

(57) ABSTRACT

An alkyl glyceryl sulfonate and/or sulfate surfactant mixture of oligomers and a detergent composition using the same to provide improved starch soil cleaning.

16 Claims, No Drawings

OLIGOMERIC ALKYL GLYCERYL SULFONATE AND/OR SULFATE SURFACTANT MIXTURE AND A DETERGENT COMPOSITION COMPRISING THE SAME

CROSS-REFERENCED APPLICATIONS

This application claims priority under 35 U.S.C. § 119(e) to U.S. provisional application No. 60/617614, filed Oct. 8, 2004.

FIELD OF INVENTION

The present invention relates to an oligomeric alkyl glyceryl sulfonate surfactant mixture and a detergent composition comprising the same.

BACKGROUND OF THE INVENTION

Alkyl glyceryl sulfonate surfactants have been utilized in the past, but have focused on maximizing the amount of monomer present, viewing dimers and other oligomers as ineffective products for cleaning purposes. However, it has been found that oligomers of alkyl glyceryl sulfonate surfactants show benefits for starch cleaning.

Consumers utilizing a liquid dishwashing detergent composition often encounter difficult to clean starch soils (deposits), such as rice, pasta, potatoes, and other starches, in their washing experience. A common solution to starch cleaning is the incorporation of enzymes, bleaches, solvents, abrasives and/or high pH into the light-duty liquid dishwashing detergent. However these solutions fail to deliver satisfactory starch cleaning to consumers.

Consumers also encounter starch soils in fabric cleaning in their washing experience.

Several technologies have been discussed that address grease cleaning in liquid dishwashing compositions. However, the desired properties of the technologies for adequate grease cleaning are distinct from that for adequate starch cleaning. Starch soils are hydrophilic and contain varying amounts of water that reduce as starch deposits dry, leading to difficult to remove starch deposits. In contrast, grease soils are hydrophobic in nature. As such, different technologies are necessary to address these different types of soils.

SUMMARY OF THE INVENTION

The present invention relates to a mixture of alkyl glyceryl sulfonate oligomers, alkyl glyceryl sulfate surfactant oligomers or mixtures thereof selected from dimers, trimers, tetramers, pentamers, hexamers, heptamers, and mixtures thereof; wherein the weight percentage of monomers is from 0 wt % to 60 wt % by weight of the surfactant mixture.

The present invention also relates to a detergent composition comprising from about 0.1% to about 10% by weight of the composition of an alkyl glyceryl sulfonate, alkyl glyceryl sulfate surfactant or mixtures thereof wherein the weight percentage of monomers of the alkyl glyceryl sulfonate surfactant is from 0% to about 60% by weight of the alkyl glyceryl sulfonate surfactant and/or alkyl glyceryl sulfate surfactant.

All documents cited are, in relevant part, incorporated herein by reference; the citation of any document is not to be construed as an admission that it is relevant art with respect to the present invention.

DETAILED DESCRIPTION OF THE INVENTION

The oligomeric alkyl glyceryl sulfonate surfactant and/or oligomeric alkyl glyceryl sulfate surfactant mixture of the present invention is believed to provide starch cleaning benefits over that of alkyl glyceryl sulfonate surfactant and/or alkyl glyceryl sulfate surfactant mixtures having higher levels (greater than 60 wt %) of monomer alkyl glyceryl sulfonate surfactants and/or alkyl glyceryl sulfate surfactants.

The detergent compositions of the present invention surprisingly provide improved starch cleaning while maintaining acceptable levels of total amount of cleaning in a liquid dishwashing detergent composition.

As used herein "starch" means materials comprising at least in part (i.e., at least 0.5 wt % by weight of the starch) amylose or amylopectin.

As used herein "deposits" means starch that are adhered to a surface, not limited in area or volume of starch that is adhered to a surface such as dishes, glass, pots, pans, baking dishes, flatware or fabric.

As used herein "liquid dishwashing detergent composition" refers to those compositions that are employed in manual (i.e. hand) dishwashing. Such compositions are generally high sudsing or foaming in nature.

As used herein "laundry detergent composition" refers to those compositions that are employed in washing clothing and other fabrics and any solutions containing the composition in a diluted form. Such compositions are generally low sudsing or foaming in nature.

Incorporated and included herein, as if expressly written herein, are all ranges of numbers when written in a "from X to Y" or "from about X to about Y" format. It should be understood that every limit given throughout this specification will include every lower or higher limit, as the case may be, as if such lower or higher limit was expressly written herein. Every range given throughout this specification will include every narrower range that falls within such broader range, as if such narrower ranges were all expressly written herein.

Unless otherwise indicated, weight percentage is in reference to weight percentage of the detergent composition. All temperatures, unless otherwise indicated are in Celsius.

Alkyl Glyceryl Sulfonate Surfactant And Alkyl Glyceryl Sulfate Surfactant

Alkyl glyceryl sulfonate surfactants and/or alkyl glyceryl sulfate surfactants generally used have high monomer content (greater than 60 wt %). However, it has been found that for starch cleaning, monomer content should be minimized and oligomer content maximized. As used herein "oligomer" includes dimer, trimer, quadrimer, and oligomers up to heptamers of alkyl glyceryl sulfonate surfactant and/or alkyl glyceryl sulfate surfactant. Minimization of the monomer content may be from 0 wt % to about 60 wt %, from 0 wt % to about 55 wt %, from 0 wt % to about 50 wt %, from 0 wt % to about 30 wt %, by weight of the alkyl glyceryl sulfonate surfactant and/or alkyl glyceryl sulfate surfactant present.

The alkyl glyceryl sulfonate surfactant and/or alkyl glyceryl sulfate surfactant for use herein include such surfactants having an alkyl chain length from $C_{10-40}$, $C_{10-22}$, $C_{12-18}$, and $C_{16-18}$. The alkyl chain may be branched or linear, wherein when present, the branches comprise a $C_{1-4}$ alkyl moiety, such as methyl ($C_1$) or ethyl ($C_2$). Generally, the structures of suitable alkyl glyceryl sulfonate surfactant oligomers that may be used herein include (A) dimers; (B) trimers, and (C) tetramers and higher oligomers not exemplified specifically below:

(A)

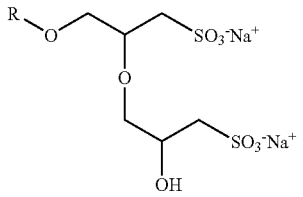

(B)

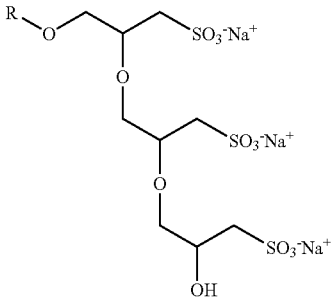

(C)

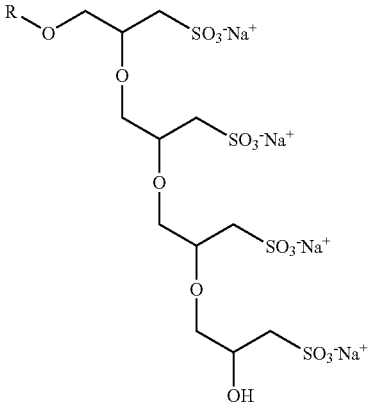

One of skill in the art will recognize that the counter-ion may be substituted with other suitable soluble cations other than the sodium shown above. R in the above structures (A)-(C) is from $C_{10-40}$, $C_{10-22}$, $C_{12-18}$, and $C_{16-18}$. The alkyl chain may be branched or linear, wherein when present, the branches comprise a $C_{1-4}$ alkyl moiety, such as methyl ($C_1$) or ethyl ($C_2$). One of skill in the art will also recognize that the corresponding alkyl glyceryl sulfate surfactant oligomers may also have similar structures with the $SO_3^-$ moiety being an $OSO_3^-$ moiety.

For comparison purposes, a monomer of alkyl glycerol sulfonate generally has the following structure:

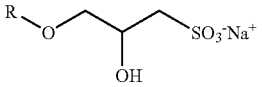

wherein R for the monomer structure is from $C_{10-40}$, $C_{10-22}$, $C_{12-18}$, and $C_{16-18}$. One of skill in the art will also recognize that the corresponding alkyl glyceryl sulfate surfactant monomer may also have similar structures with the $SO_3^-$ moiety being an $OSO_3^-$ moiety.

The alkyl glyceryl sulfonate surfactant and/or alkyl glyceryl sulfate surfactant oligomer content may be between about 40 wt % and 100 wt %, about 45 wt % and 100 wt %, about 50 wt % and 100 wt %, about 70 wt % and 100 wt % by weight of the alkyl glycerol sulfonate surfactant and/or alkyl glyceryl sulfate surfactant. As used herein, the "oligomer content" means the sum of the alkyl glyceryl sulfonate surfactant oligomers and/or alkyl glyceryl sulfate surfactant oligomers, such as dimers, trimers, quadrimers, and above (heptamers) present in the alkyl glyceryl sulfonate surfactant and/or alkyl glyceryl sulfate surfactant. More specifically, as shown below in Table I, nonlimiting examples of alkyl glyceryl sulfonate surfactant oligomer content demonstrates the weight percent of oligomers present and the minimization of the monomer content of the alkyl glyceryl sulfonate surfactant.

TABLE I

| Sample | Chain Length | % Monomer | % Dimer | % Trimer | % Quadrimer | % (Dimer + Trimer + Quadrimer) | Molar ratio alcohol:epichlorohydrin |
|---|---|---|---|---|---|---|---|
| OAGS 1 | C16-18 | 9.4 | 25.4 | 19.2 | 46.0 | 90.6 | 1:4.02 |
| OAGS 2 | C16-18 | 25.0 | 41.6 | 12.3 | 20.9 | 74.9 | 1:2.35 |
| OAGS 3 | C16-18 | 54.5 | 35.5 | 6.2 | 3.8 | 45.5 | 1:1.49 |
| OAGS 4 | C12-14 | 16.3 | 30.6 | 35.7 | 17.3 | 83.7 | 1:3.02 |
| OAGS 5 | C12-14 | 27.5 | 38.5 | 26.6 | 7.4 | 72.5 | 1:2.31 |
| OAGS 6 | C12-14 | 43.2 | 37.8 | 15.6 | 3.4 | 56.8 | 1:1.79 |
| AGS 7* | C12-14 | 76.1 | 21.0 | 2.8 | 0.1 | 23.9 | 1:1.24 |

*AGS 7 is a comparative example of commercially available alkyl glyceryl sulfonate surfactant.

When present in a detergent composition, the alkyl glyceryl sulfonate surfactant oligomer mixture is present from 0.1% to 10%, 0.5% to 5%, 1.0% to 4% by weight of the detergent composition.

Process of Making Oligomeric Alkyl Glyceryl Sulfonate Surfactant

Step 1 is the production of oligomeric alkyl chlorogylceryl ether. The initial reactant is an alcohol consisting of the desired chainlength, such as a $C_{16-18}$ or a $C_{12-14}$ alcohol commercially available from Procter and Gamble Chemicals Division, and branching if applicable. Heat the initial alcohol to 65° C. (150° F.) and add stannic chloride in a mass ratio of initial alcohol:stannic chloride of 100:0.67. Maintain the reaction temperature between 65° C. (150° F.) and 80° C. (175° F.) while adding epichlorohydrin. The amount of epichlorohydrin is dependent upon the weight percentage of oligomers desired, such as those shown in Table I above. Typical molar ratios of alcohol:epichlorohydrin range from 1:1.49 to 1:4.02. Non-limiting examples are shown above in Table 1. Slowly add the epichlorohydrin at about 12 mL/min to help control the exotherm upon its addition. Maintain the temperature between 65° C. (150° F.) and 90° C. (194° F.) for 30 minutes or more until the desired oligom are obtained. Gas chromatography may be used to determine if desired oligomeric alkyl chloroglyceryl ethers are obtained.

Step 2 is the production of oligomeric alkyl glycidyl ether. Heat the solution from step 1 above to 90° C. (195° F.). Add a 35% aqueous solution of sodium hydroxide to the solution from step 1 in a molar ratio of initial alcohol:NaOH of 1:1.5. React the resulting solution for one hour. Cool the mixture to room temperature (20-25° C.) and separate an aqueous layer from an organic layer containing the oligomeric alkyl glycidyl ether.

Step 3 is sulfonation of the oligomeric alkyl glycidyl ethers using a mixture of sodium bisulfite and sodium sulfite. Combine the oligomeric alkyl glycidyl ethers from step 2 with water, sodium meta-bisulfite and sodium hydroxide. The sodium hydroxide and sodium meta-bisulfite should be added according to the following formula with little to no excess:

$$\text{moles of NaOH} = \sum_{i=1}^{X} (ACE_i * (i) + AGE_i * (i-1))$$

$$\text{moles of } Na_2S_2O_5 = \frac{\text{moles of NaOH} + \sum_{i=1}^{X} AGE_i}{2}$$

where ACE refers to the moles of oligomeric alkyl chloroglyceryl ethers, AGE refers to the moles of oligomeric alkyl glycidyl ethers, X refers to the largest oligomer present and i refers to the specific oligomer (i.e. i=2 for dimers, i=3 for trimers, etc.) Add water in the appropriate amount for the final solution to be between 40 wt % and 45 wt % water. If applicable, a heel of previously produced AGS with the same desired chainlength can be used at about 6 wt % of the total reaction mass to help emulsify the organic and aqueous layers. Well stir the final solution and heat until the final solution is 182° C. (360° F.). Hold the final solution at around 182° C. (360° F.) for about 25 minutes and then cool the final solution to room temperature (20-25° C.). Add sodium hydroxide and hydrogen peroxide in an amount to obtain a pH between 8.5 and 10.7 and lower the concentration of free sulfites such that the free sulfite concentration is below 0.1 wt %. Free sulfites may be eliminated via the addition of hydrogen peroxide to produce the corresponding sulfates. Recover the desired oligomeric alkyl glycerol sulphonate surfactant.

Aqueous Liquid Carrier

The detergent compositions herein may further contain from about 30% to about 80% of an aqueous liquid carrier in which the other essential and optional compositions components are dissolved, dispersed or suspended. More preferably the aqueous liquid carrier will comprise from about 45% to about 70%, more preferable from about 45% to about 65% of the compositions herein.

One preferred component of the aqueous liquid carrier is water. The aqueous liquid carrier, however, may contain other materials which are liquid, or which dissolve in the liquid carrier, at room temperature (20° C.-25° C.) and which may also serve some other function besides that of an inert filler. Such materials can include, for example, hydrotropes and solvents, discussed in more detail below. Dependent on the geography of use of the detergent composition of the present invention, the water in the aqueous liquid carrier can have a hardness level of about 2-30 gpg ("gpg" is a measure of water hardness that is well known to those skilled in the art, and it stands for "grains per gallon").

pH of the Composition

The composition may have any suitable pH. Preferably the pH of the composition is adjusted to between 4 and 14. More preferably the composition has pH of between 6 and 13, most preferably between 6 and 10. The pH of the composition can be adjusted using pH modifying ingredients known in the art.

Thickness of the Composition

The compositions of the present invention are preferably thickened and have viscosity of greater than 700 cps, when measured at 20° C. More preferably the viscosity of the composition is between 700 and 1100 cps. The present invention excludes compositions which are in the form of microemulsions.

Surfactants

Surfactants may be present in the detergent composition of the present invention. Included as optional surfactants are amine oxides, anionic surfactants, nonionic surfactants and ampholytic surfactants.

Amine Oxide surfactants

A component used in the detergent composition of the present invention is linear amine oxides. Amine oxides, for use herein, include water-soluble amine oxides containing one $C_{8-18}$ alkyl moiety and 2 moieties selected from the group consisting of $C_{1-3}$ alkyl groups and $C_{1-3}$ hydroxyalkyl groups; water-soluble phosphine oxides containing one $C_{10-18}$ alkyl moiety and 2 moieties selected from the group consisting of $C_{1-3}$ alkyl groups and $C_{1-3}$ hydroxyalkyl groups; and water-soluble sulfoxides containing one $C_{10-18}$ alkyl moiety and a moiety selected from the group consisting of $C_{1-3}$ alkyl and $C_{1-3}$ hydroxyalkyl moieties.

Preferred amine oxide surfactants have formula (I):

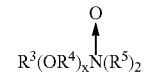

(I)

wherein $R^3$ of formula (I) is an $C_{8-22}$ alkyl, $C_{8-22}$ hydroxyalkyl, $C_{8-22}$ alkyl phenyl group, and mixtures thereof; $R^4$ of formula (I) is an $C_{2-3}$ alkylene or $C_{2-3}$ hydroxyalkylene group or mixtures thereof; x is from 0 to about 3; and each $R^5$ of formula (I) is an $C_{1-3}$ alkyl or $C_{1-3}$ hydroxyalkyl group or a polyethylene oxide group containing an average of from about 1 to about 3 ethylene oxide groups. The $R^5$ groups of formula (I) may be attached to each other, e.g., through an oxygen or nitrogen atom, to form a ring structure.

These amine oxide surfactants in particular include $C_{10-18}$ alkyl dimethyl amine oxides and $C_8$-$C_{12}$ alkoxy ethyl dihydroxy ethyl amine oxides. Preferred amine oxides include $C_{10}$, $C_{10}$-$C_{12}$, and $C_{12}$-$C_{14}$ alkyl dimethyl amine oxides.

At least one amine oxide will be present in the detergent composition from about 0.1% to about 15%, more preferably at least about 0.2% to about 12% by weight of the composition. In one embodiment, the amine oxide is present in the detergent composition from about 5% to about 12% by weight of the composition. In another embodiment, the amine oxide is present in the detergent composition from about 3% to about 8% by weight of the composition.

Anionic Surfactants

The anionic surfactant is optionally present at a level of at least 15%, more preferably from 20% to 40% and most preferably from 25% to 40% by weight of the detergent composition.

Suitable anionic surfactants for use in the detergent compositions herein include water-soluble salts or acids of $C_6$-$C_{20}$ linear or branched hydrocarbyl, preferably an alkyl, hydroxyalkyl or alkylaryl, having a $C_{10}$-$C_{20}$ hydrocarbyl component, more preferably a $C_{10}$-$C_{14}$ alkyl or hydroxyalkyl, sulfate or sulfonates. Suitable counterions include hydrogen, alkali metal cation or ammonium or substituted ammonium, but preferably sodium. Where the hydrocarbyl chain is branched, it preferably comprises $C_{1-4}$ alkyl branching units. The average percentage branching of the anionic surfactant is preferably greater than 30%, more preferably from 35% to 80% and most preferably from 40% to 60% of the total hydrocarbyl chains.

Anionic surfactants may be selected from $C_{11}$-$C_{18}$ alkyl benzene sulfonates (LAS), -$C_{20}$ primary, branched-chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein preferably x is from 1-30; $C_{10}$-$C_{18}$ alkyl alkoxy carboxylates preferably comprising 1-5 ethoxy units; mid-chain branched alkyl sulfates as discussed in U.S. Pat. No. 6,020,303 and U.S. Pat. No. 6,060,443; mid-chain branched alkyl alkoxy sulfates as discussed in U.S. Pat. No. 6,008,181 and U.S. Pat. No. 6,020,303; modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulfonate (MES); and alpha-olefin sulfonate (AOS).

Nonionic Surfactants

Optionally nonionic surfactant, when present in the detergent composition, is present in an effective amount, more preferably from 0.1% to 20%, even more preferably 0.1% to 15%, even more preferably still from 0.5% to 10%,by weight of the composition.

Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from 2 to 18 moles of ethylene oxide per mole of alcohol. Also suitable are alkylpolyglycosides having the formula $R^2O(C_nH_{2n}O)_t(\text{glycosyl})_x$ (formula (II)), wherein $R^2$ of formula (II) is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n of formula (II) is 2 or 3, preferably 2; t of formula (II) is from 0 to 10, preferably 0; and x of formula (II) is from 1.3 to 10, preferably from 1.3 to 3, most preferably from 1.3 to 2.7. The glycosyl is preferably derived from glucose.

Also suitable are fatty acid amide surfactants having the formula (III):

$$R^6\overset{\overset{\displaystyle O}{\|}}{C}N(R^7)_2 \qquad \text{(III)}$$

wherein $R^6$ of formula (III) is an alkyl group containing from 7 to 21, preferably from 9 to 17, carbon atoms and each $R^7$ of formula (III) is selected from the group consisting of hydrogen, $C_1$-$C_4$ alkyl, $C_1$-$C_4$ hydroxyalkyl, and $—(C_2H_4O)_xH$ where x of formula (III) varies from 1 to 3. Preferred amides are $C_8$-$C_{20}$ ammonia amides, monoethanolamides, diethanolamides, and isopropanolamides.

Ampholytic Surfactants

Other suitable, non-limiting examples of amphoteric surfactants that are optional in the detergent composition herein include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group.

Typically, when present, ampholytic surfactants comprise from about 0.01% to about 20%, preferably from about 0.5% to about 10% by weight of the detergent composition.

Solvent

The present compositions may optionally comprise a solvent. Suitable solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof.

Preferred solvents are selected from methoxy octadecanol, ethoxyethoxyethanol, benzyl alcohol, 2-ethylbutanol and/or 2-methylbutanol, 1-methylpropoxyethanol and/or 2-methylbutoxyethanol, linear $C_1$-$C_5$ alcohols such as methanol, ethanol, propanol, isopropanol, butyl diglycol ether (BDGE), butyltriglycol ether, tert-amyl alcohol, glycerol and mixtures thereof. Particularly preferred solvents which can be used herein are butoxy propoxy propanol, butyl diglycol ether, benzyl alcohol, butoxypropanol, propylene glycol, glycerol, ethanol, methanol, isopropanol and mixtures thereof.

Other suitable solvents for use herein include propylene glycol derivatives such as n-butoxypropanol or n-butoxypropoxypropanol, water-soluble CARBITOL R® solvents or water-soluble CELLOSOLVE R® solvents. Water-soluble CARBITOL R® solvents are compounds of the 2-(2-alkoxyethoxy)ethanol class wherein the alkoxy group is derived from ethyl, propyl or butyl; a preferred water-soluble CARBITOL® is 2-(2-butoxyethoxy)ethanol, also known as BUTYL CARBITOL®. Water-soluble CELLOSOLVE R® solvents are compounds of the 2-alkoxyethoxy ethanol class, with 2-butoxyethoxyethanol being preferred. Other suitable solvents include benzyl alcohol, and diols such as 2-ethyl-1,3-hexanediol and 2,2,4-trimethyl-1,3-pentanediol and mixtures thereof. Some preferred solvents for use herein are n-butoxypropoxypropanol, 2-(2-butoxyethoxy)ethanol and mixtures thereof.

The solvents can also be selected from the group of compounds comprising ether derivatives of mono-, di- and triethylene glycol, butylene glycol ethers, and mixtures thereof. The weight average molecular weights of these solvents are preferably less than 350, more preferably between 100 and 300, even more preferably between 115 and 250. Examples of preferred solvents include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename DOWANOL® and from the Arco Chemical Company under the tradename ARCOSOLV®. Other preferred solvents including mono- and di-ethylene glycol n-hexyl ether are available from the Union Carbide Corporation.

When present, the detergent composition will contain 0.01% -20%, preferably 0.5% -20%, more preferably 1% -10% by weight of the detergent composition of a solvent.

These solvents may be used in conjunction with an aqueous liquid carrier, such as water, or they may be used without any aqueous liquid carrier being present.

Hydrotrope

The detergent compositions of the invention may optionally comprise a hydrotrope in an effective amount so that the detergent compositions are appropriately compatible in water. By "appropriately soluble in water", it is meant that the product dissolves quickly enough in water as dictated by both the washing habit and conditions of use. Products that do not dissolve quickly in water can lead to negatives in performance regarding overall grease and/or cleaning, sudsing, ease of rinsing of product from surfaces such as dishes/glasses etc. or product remaining on surfaces after washing. Inclusion of hydrotropes also serves to improve product stability and formulatibility as is well known in the literature and prior art.

Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, and related compounds, as disclosed in U.S. Pat. No. 3,915,903.

The detergent compositions of the present invention typically comprise from 0% to 15% by weight of the detergent composition of a hydrotropic, or mixtures thereof, preferably from 1% to 10%, most preferably from 3% to 6% by weight.

Magnesium Ions

The optional presence of magnesium ions may be utilized in the detergent composition when the compositions are used in softened water that contains few divalent ions. When utilized, the magnesium ions preferably are added as a hydroxide, chloride, acetate, sulfate, formate, oxide or nitrate salt to the compositions of the present invention.

When included, the magnesium ions are present at an active level of from 0.01% to 1.5%, preferably from 0.015% to 1%, more preferably from 0.025% to 0.5%, by weight of the detergent composition.

Hydrophobic Block Polymer

The detergent compositions of the invention may optionally comprise a hydrophobic block polymer having alkylene oxide moieties and a weight average molecular weight of at least 500, but preferably less than 10,000, more preferably from 1000 to 5000 and most preferably from 1500 to 3500. Suitable hydrophobic polymers have a water solubility of less than about 1%, preferably less than about 0.5%, more preferably less than about 0.1% by weight of the polymer at 25° C.

"Block polymers" as used herein is meant to encompass polymers including two or more different homopolymeric and/or monomeric units which are linked to form a single polymer structure. Preferred copolymers comprise ethylene oxide as one of the monomeric units. More preferred copolymers are those with ethylene oxide and propylene oxide. The ethylene oxide content of such preferred polymers is more than about 5 wt %, and more preferably more than about 8 wt %, but less than about 50 wt %, and more preferably less than about 40 wt %. A preferred polymer is ethylene oxide/propylene oxide copolymer available from BASF under the tradename PLURONIC L81® or PLURONIC L43®.

The detergent compositions of the present invention optionally comprise from 0% to 15% by weight of the detergent composition of one or more hydrophobic block polymer(s), preferably from 1% to 10%, most preferably from 3% to 6% by weight.

Thickening Agent

The detergent compositions herein can also contain from about 0.2% to 5% by weight of the detergent composition of a thickening agent. More preferably, such a thickening agent will comprise from about 0.5% to 2.5% of the detergent compositions herein. Thickening agents are typically selected from the class of cellulose derivatives. Suitable thickeners include hydroxy ethyl cellulose, hydroxyethyl methyl cellulose, carboxy methyl cellulose, cationic hydrophobically modified hydroxyethyl cellulose, available from Amerchol Corporation as QUATRISOFT® LM200, and the like. A preferred thickening agent is hydroxypropyl methylcellulose.

Polymeric Suds Stabilizer

The detergent compositions of the present invention may optionally contain a polymeric suds stabilizer. These polymeric suds stabilizers provide extended suds volume and suds duration of the detergent compositions. These polymeric suds stabilizers may be selected from homopolymers of (N,N-dialkylamino) alkyl esters and (N,N-dialkylamino) alkyl acrylate esters. The weight average molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely the acrylate ester represented by the formula (IV):

(IV)

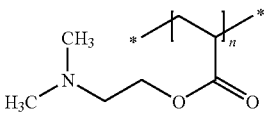

When present in the compositions, the polymeric suds booster may be present in the composition from 0.01% to 15%, preferably from 0.05% to 10%, more preferably from 0.1% to 5%, by weight.

Diamines

Another optional ingredient of the compositions according to the present invention is a diamine. Since the habits and practices of the users of detergent compositions show considerable variation, the composition will preferably contain 0% -15%, preferably 0.1% -15%, preferably 0.2% -10%, more preferably 0.25% -6%, more preferably 0.5%-1.5% by weight of said composition of at least one diamine.

Preferred organic diamines are those in which pK1 and pK2 are in the range of 8.0 to 11.5, preferably in the range of 8.4 to 11, even more preferably from 8.6 to 10.75. Preferred materials include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EP®) (pK1=10.5; pK2=8.9), 2-methyl 1,5 pentane diamine (DYTEK A®) (pK1=11.2; pK2=10.0). Other preferred materials include primary/primary diamines with alkylene spacers ranging from $C_4$ to $C_8$. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by DUPONT®, a supplier of diamines. As a working definition herein, the pKa of the diamines is specified in an all-aqueous solution at 25° C. and for an ionic strength between 0.1 to 0.5 M.

Preferably, the detergent compositions herein are formulated as clear liquid compositions. By "clear" it is meant stable and transparent. In order to achieve clear compositions, the use of solvents and hydrotropes is well known to those familiar with the art of light-duty liquid dishwashing compositions. Preferred detergent compositions in accordance with the invention are clear single phase liquids, but the invention also embraces clear and opaque products containing dispersed phases, such as beads or pearls as described in U.S. Pat. No. 5,866,529, to Erilli, et al., and U.S. Pat. No. 6,380,150, to Toussaint, et al., provided that such products are physically stable (i.e., do not separate) on storage.

The detergent compositions of the present invention may be packages in any suitable packaging for delivering the detergent composition for use. Preferably the package is a clear package made of glass or plastic.

Other Optional Components

The detergent compositions herein can further comprise a number of other optional ingredients suitable for use in detergent compositions such as perfume, dyes, opacifiers, and pH buffering means so that the detergent compositions herein generally have a pH of from 4 to 14, preferably 6 to 13, most preferably 6 to 10. A further discussion of acceptable optional ingredients suitable for use in detergent compositions, specifically light-duty detergent composition may be found in U.S. Pat. No. 5,798,505.

Method of Use

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention diluted in water. The actual amount of detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. Suitable examples may be seen below in Table II.

Generally, from about 0.01 ml. to about 150 ml., preferably from about 3 ml. to about 40 ml. of a detergent composition of the invention is combined with from about 2000 ml. to about 20000 ml., more typically from about 5000 ml. to about 15000 ml. of water in a sink having a volumetric capacity in the range of from about 1000 ml. to about 20000 ml., more typically from about 5000 ml. to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of use will comprise immersing the soiled dishes into a water bath without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

The present invention includes a method for cleaning a surface or fabric. Such method includes the steps of contacting a alkyl glyceryl sulphonate surfactant oligomers and/or alkyl glyceryl sulfate surfactant oligomers of the present invention or an embodiment of the detergent composition comprising the alkyl glyceryl sulphonate surfactant oligomers and/or alkyl glyceryl sulfate surfactant oligomers the present invention, in neat form or diluted in a wash liquor, with at least a portion of a surface or fabric then optionally rinsing such surface or fabric. Preferably the surface or fabric is subjected to a washing step prior to the aforementioned optional rinsing step. For purposes of the present invention, washing includes but is not limited to, scrubbing, and mechanical agitation.

Test Methods

Starch Cleaning Method

Rice

Prepare pre-cooked instant enriched rice by adding to water and boiling the rice for a time period such that most of the water (more than 94 vol %) is adsorbed by the rice. Blend the cooked rice with a small amount of water such that a paste results when placed in a blender on high power for 30 seconds. Weigh and record the weight of a 7.62 cm by 3.81 cm (0.0625 thick) (3 in. by 1.5 in. (1/16 in thick)) steel metal slide. Brush 5 grams of the rice paste onto the metal slide to prepare a sample. Place the sample into a chamber at 25° C. for 48 hours at a relative humidity of 58%. Maintain the relative humidity with a saturated sodium bromide solution in a 56.6 L (3456 $in^3$) sealed container.

Potatoes

Mix 142 g. (5 oz.) dried potato slices with 270 mL (2 cups) water, 180 mL (3/4 cup) milk and 30 mL (2 Tbsp) butter with the dried potato slices. Cook the mixture in a baking dish at 96.1° C. (205° F.) for 30-35 minutes. Weigh and record the weight of a 7.62 cm by 3.81 cm (0.0625 thick) (3 in. by 1.5 in. (1/16 in. thick)) steel metal slide. Place 0.3-0.5 g of cooked potatoes onto the steel metal slide to prepare a sample. Cook the sample at 96.1° C. (205° F.) for 5 minutes. Allow the sample to cool to room temperature (20° C.).

Pasta

Prepare 200 g of macaroni in boiling water for 15 minutes. Drain excess water from macaroni and blend the pasta in a food processor for 2 minutes. Weigh and record the weight of a 75 mm by 38 mm (0.96-1.06 mm thick) (3 in. by 1.5 in. (~1/30 in. thick)) glass PYREX®slide. Place 0.3-0.5 g of prepared pasta onto the glass slide to form a sample. Cook the sample at 96.1° C. (205° F.) for 5 minutes. Allow the sample to cool to room temperature (20° C.).

Washing Steps

Prepare a solution of 2100 mL of deionized water adjusted to a 7 gpg hardness and 100 ppm bicarbonate. Heat the solution to 48.9° C. (120° F.). Add any one of the detergent formulations shown in Tables I and II below, to make a 2700 ppm detergent solution. In a 400 mL glass beaker add 300 mL of the prepared detergent solution and allow the detergent solution to cool to a temperature of 46.1° C. (115° F.). Add the metal/glass slide sample to the 46.1° C. (115° F.) detergent solution such that the starch deposit is submerged and soak for 5 minutes with agitation (at ~200 rpm with a stir bar). Remove the sample from the detergent solution. Wet a sponge with the detergent solution and wipe over the sample surface having the starch deposit twice (once forward and once backwards). Rinse the sample in distilled water. Allow the sample to dry for 12 to 14 hours at room temperature (25° C.) and weigh to determine the amount of starch deposit (soil) removed.

Viscosity Test Method

The viscosity of the composition of the present invention is measured on a Brookfield viscometer model # LVDVII+ at 20° C. The spindle used for these measurements is S31 with the appropriate speed to measure products of different viscosities; e.g., 12 rpm to measure products of viscosity greater than 1999 cps; 30 rpm to measure products with viscosities between 500 cps-1000 cps; 60 rpm to measure products with viscosities less than 500 cps.

Formulations Table II

Liquid Dishwashing Detergent Compositions

| Composition | Control | A | B | C | D | E | F |
|---|---|---|---|---|---|---|---|
| $C_{12-13}$ $AE_{0.6}S$ [1] | 29.0 | 29.0 | 29.0 | 29.0 | 29.0 | 29.0 | 29.0 |
| $C_{12-14}$ Dimethyl Amine Oxide | 6.5 | 6.5 | 6.5 | 6.5 | 6.5 | 6.5 | 6.5 |
| OAGS 1 | — | 3.0 | — | — | — | — | — |
| OAGS 2 | — | — | 3.0 | — | — | — | — |
| OAGS 3 | — | — | — | 3.0 | — | — | — |
| OAGS 4 | — | — | — | — | 3.0 | — | — |
| OAGS 5 | — | — | — | — | — | 3.0 | — |
| OAGS 6 | — | — | — | — | — | — | 3.0 |
| $C_{12-13}$ branched ethoxylated alcohol containing an average of 3 ethoxy groups[2] | 2.5 | 2.5 | 2.5 | 2.5 | 2.5 | 2.5 | 2.5 |
| Ethanol | 4.2 | 4.2 | 4.2 | 4.2 | 4.2 | 4.2 | 4.2 |
| NaCl | 0.6 | 0.6 | 0.6 | 0.6 | 0.6 | 0.6 | 0.6 |
| Sodium citrate dihydrate | 1.0 | 1.0 | 1.0 | 1.0 | 1.0 | 1.0 | 1.0 |
| Suds boosting polymer [3] | 0.1 | 0.1 | 0.1 | 0.1 | 0.1 | 0.1 | 0.1 |
| Pluronic 1-81 EO:PO | 0.5 | 0.5 | 0.5 | 0.5 | 0.5 | 0.5 | 0.5 |
| Dye | 0.00125 | 0.00125 | 0.00125 | 0.00125 | 0.00125 | 0.00125 | 0.00125 |
| Perfume | 0.22 | 0.22 | 0.22 | 0.22 | 0.22 | 0.22 | 0.22 |
| Water | Balance | Balance | Balance | Balance | Balance | Balance | Balance |

[1] $C_{12-13}$ alkyl ethoxy sulfonate containing an average of 0.6 ethoxy groups.

[2] such as those available under the tradenames or derived from alcohols under the tradenames LIAL ®, SAFOL ®, LUTENSOL ®, NEODOL ®, and those described by U.S. Pat. No. 6,008,181. SAFOL ® 23-3 is $C_{12-13}$ branched ethoxylated alcohol with 3 ethoxy groups.

[3] (N,N-dimethylamino)ethyl methacrylate homopolymer

TABLE III

Heavy Duty Laundry Detergent

| Ingredients | G wt % |
|---|---|
| Linear alkylbenzenesulfonate | 10-15 |
| $C_{12-15}$ alcohol ethoxy $_{(1.1-2.5)}$ sulfate | 1-5 |
| $C_{12-13}$ alcohol ethoxylate$_{(7-9)}$ | 1-5 |
| cocodimethyl amine oxide | 0.1-1 |
| fatty acid | 1-5 |
| citric acid | 1-5 |
| OAGS[1] | 1.0-10 |
| Polymer a[2] | 0.1-1.5 |
| Polymer b[3] | 0.1-1.5 |
| hydroxylated castor oil (structurant) | 5-20 |
| Water, perfumes, dyes, and other trace components | Balance |

[1]any of OAGS 1-6 in Table I above.
[2]one or more polymers according to U.S. Pat. No. 4,891,160, VanderMeer, et al.
[3]one or more polymers according to WO 00/105923, Price, et al.

TABLE IV

Low Sudsing Granular Laundry Cleaning Compositions

| Formula | H wt % | I wt % | J wt % |
|---|---|---|---|
| $C_{11-12}$ Linear alkyl benzene sulphonate | 7 | 5.1 | 10.2 |
| $C_{12-18\ (tallow)}$ alkyl sulfate | 1 | 1 | 1 |
| $C_{14-15}$ alkyl ethoxylate (EO = 7) | 3.2 | 3.2 | 3.2 |
| APA[1] | 0.94 | 0.68 | 1.36 |
| silicate builder[2] | 4.05 | — | — |
| Zeolite A[3] | 16.65 | — | — |
| Carbonate[4] | 14.04 | — | — |
| Citric Acid (Anhydrous) | 2.93 | 2.93 | 2.93 |
| OAGS[5] | 1.0-10 | 1.0-10 | 1.0-10 |
| acrylic acid/maleic acid copolymer[6] | 0.97 | 0.97 | 0.97 |
| Polymer[7] | 1-5 | 1-5 | 1-5 |
| Percarbonate | 12.8 | 16.18 | 13.25 |
| tetraacetylethylenediamine | 3.64 | 5.92 | 3.95 |
| 1-hydroxyethyidene-1,1-diphosphonic acid | 0.18 | 0.18 | 0.18 |
| S,S-(ethylenediamine N,N'-disuccinic acid) | 0.2 | 0.2 | 0.2 |
| $MgSO_4$ | 0.42 | 0.42 | 0.42 |
| ENZYMES[8] (% particle) | 1.26 | 1.26 | 1.26 |
| MINORS (perfume, dyes, suds stabilizers) | Balance | Balance | Balance |

[1]$C_{8-10}$ amido propyl dimethyl amine
[2]Amorphous Sodium Silicate ($SiO_2$:$Na_2O$; 2.0 ratio)
[3]Hydrated Sodium Aluminosilicate of formula $Na_{12}(Al0_2SiO_2)_{12}\bullet 27H_2O$ having a primary particle size in the range from 0.1 to 10 micrometers
[4]Anhydrous sodium carbonate with a particle size between 200 μm and 900 μm
[5]any of OAGS 1-6 in Table I above.
[6]4:1 acrylic acid/maleic acid, average molecular weigh about 70,000 or 6:4 acrylic acid/maleic acid, average molecular weight about 10,000)
[7]U.S. Pat. No. 4,659,802, Rubingh et al. Example 2a:
[8]one or more enzymes such as:
Protease - Proteolytic enzyme, having 3.3% by weight of active enzyme, sold by NOVO Industries A/S under the tradename SAVINASE ®; Proteolytic enzyme, having 4% by weight of active enzyme, as described in WO 95/10591, sold by Genencor Int. Inc.
Alcalase- Proteolytic enzyme, having 5.3% by weight of active enzyme, sold by NOVO Industries A/S
Cellulase - Cellulytic enzyme, having 0.23% by weight of active enzyme, sold by NOVO Industries A/S under the tradename CAREZYME ®.
Amylase - Amylolytic enzyme, having 1.6% by weight of active enzyme, sold by NOVO Industries A/S under the tradename TERMAMYL 120T ®; Amylolytic enzyme, as disclosed in PCT/U.S. Pat. No. 9,703,635.
Lipase - Lipolytic enzyme, having 2.0% by weight of active enzyme, sold by NOVO Industries A/S under the tradename LIPOLASE ®; Lipolytic enzyme, having 2.0% by weight of active enzyme, sold by NOVO Industries A/S under the tradename LIPOLASE ULTRA ®.
Endolase - Endoglucanase enzyme, having 1.5% by weight of active enzyme, sold by NOVO Industries A/S.

TABLE V

Granular Laundry Cleaning Compositions

| | K wt % | L wt % | M wt % | N wt % |
|---|---|---|---|---|
| $C_{10-12}$ linear alkyl sulphonate | 15.0 | 17.5 | 12.7 | 12.7 |
| $C_{12-14}$ alkyl ethoxylate (EO = 7) | 1.8 | 1.8 | — | — |
| $C_{12-14}$ alkyl ethoxylate (EO = 9) | — | — | 3.8 | 3.0 |
| Builder[1] | 25.0 | — | — | — |
| Sequestrant[2] | — | 22.5 | — | — |
| enzyme | 0.35 | 0.40 | — | — |
| OAGS[3] | 1.0-10 | 1.0-10 | 1.0-10 | 1.0-10 |
| Polymer[4] | 0.75 | 1.0 | — | — |
| Carboxy Methyl Cellulose | 0.2 | 0.2 | 0.5 | 0.5 |
| suds suppressor[5] | 0.01 | 0.01 | — | — |
| Polyacrylate[6] | 0.80 | 1.0 | 0.5 | 0.5 |
| buffer | 4.0 | 2.0 | 6.0 | 6.0 |
| Carbonate | 11.0 | 15.0 | 8.0 | 8.0 |
| brightener | 0.08 | 0.08 | 0.03 | 0.03 |
| Sodium Sulfate | 34.83 | 32.33 | 65.09 | 65.09 |
| Minors, dyes, perfumes, water | Balance | Balance | Balance | Balance |

[1]sodium tripolyphosphate
[2]Zeolite A: Hydrated Sodium Aluminosilicate of formula $Na_{12}(Al0_2SiO_2)_{12}\bullet 27H_2O$ having a primary particle size in the range from 0.1 to 10 micrometers
[3]any of OAGS 1-6 in Table I above.
[4]A polymer according to U.S. Pat. No. 4,661,288
[5]suds suppressor
[6]Mw = 4500

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

a) from about 0.1% to about 10% by weight of the composition of an alkyl glyceryl sulfonate surfactant, an alkyl glyceryl sulfate surfactant, and mixtures thereof wherein the weight percentage of monomers of the alkyl glyceryl sulfonate surfactant and/or alkyl glyceryl sulfate surfactant is from 0% to about 60% by weight of the surfactant; and b) the balance being other detergent composition adjuncts.

2. The detergent composition according to claim 1 wherein the alkyl glyceryl sulfonate surfactant, the alkyl glyceryl sulfate surfactant, and mixtures thereof is selected from dimers, trimers, tetramers, pentamers, hexamers, heptamers, and mixtures thereof.

3. The detergent composition according to claim 1 wherein the alkyl glyceryl sulfonate surfactant, alkyl glyceryl sulfate surfactant, and mixtures thereof comprise an alkyl chain length from $C_{10-44}$.

4. The detergent composition according to claim 1 wherein the alkyl glyceryl sulfonate surfactant, alkyl glyceryl sulfate surfactant, and mixtures thereof comprises a $C_{12-18}$ alkyl chain; wherein the alkyl chain may be a linear or comprise a $C_{1-4}$ alkyl branch.

5. The detergent composition according to claim 1 wherein the detergent composition further comprises from 30% to 80% by weight of the liquid detergent composition of a aqueous liquid carrier and from about 5% to about 10% by weight of the composition of a linear amine oxide.

6. The detergent composition according to claim 1 wherein the detergent composition further comprises from about 0.1% to about 20% by weight of the detergent composition of an anionic surfactant, a nonionic surfactant, and mixtures thereof.

7. The detergent composition according to claim 1 wherein the detergent composition further comprises from 30% to 80% by weight of the liquid detergent composition of a aqueous liquid caffier and from about 3% to about 8% by weight of the composition of a linear amine oxide and from about 0.1% to about 20% by weight of the detergent composition of a nonionic surfactant.

8. The detergent composition according to claim 6 wherein the nonionic surfactant selected from the group of $C_8$-$C_{22}$ aliphatic alcohols with 1 to 25 moles of ethylene oxide, alkylpolyglycosides, fatty acid amide surfactants, and mixtures thereof.

9. The detergent composition of claim 8 further comprises from 0.01% to 20% by weight of the detergent composition of a solvent and from 0% to about 15% by weight of the detergent composition of a hydrotrope.

10. The detergent composition of claim 9 further comprising from 0% to about 15% by weight of the detergent composition of a hydrophobic block polymer.

11. The detergent composition according to claim 9 further comprising from about 0.1% to about 4% by weight of the detergent composition of magnesium ions, from about 0% to about 15% by weight of the detergent composition of a diamine, or mixtures thereof.

12. The detergent composition according to claim 9 further comprising from about 0.01% to about 15% by weight of the detergent composition of a suds boosting polymer, a polymeric suds stabilizer, or mixtures thereof.

13. The detergent composition according to claim 9 further comprising one or more of the following; from about 0.2% to about 5% by weight of a thickener, from about 0.5% to about 59% by weight of a builder, from about 0.1% to about 5% by weight of a carboxylic acid, from about 0.0001% to about 5% by weight of an enzyme, and from about 0.00015% to about 15% by weight of a chelating agent.

14. The detergent composition according to claim 1 wherein the detergent composition is a clear liquid.

15. The detergent composition according to claim 6 wherein the anionic surfactant is selected from linear alkyl sulphonate, alkyl sulfate, alkoxylated alkyl sulfate, and mixtures thereof.

16. The detergent composition according to claim 4 wherein the alkyl glyceryl sulfonate surfactant, alkyl glyceryl sulfate surfactant, and mixtures thereof is selected from a $C_{12-14}$ alkyl chain or a $C_{16-18}$ alkyl chain; wherein the alkyl chain may be a linear or comprise a $C_{1-4}$ alkyl branch.

* * * * *